US007726977B2

(12) United States Patent
Hsu

(10) Patent No.: US 7,726,977 B2
(45) Date of Patent: Jun. 1, 2010

(54) ELECTRICAL CONNECTOR

(75) Inventor: Shuo-Hsiu Hsu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/151,603

(22) Filed: May 7, 2008

(65) Prior Publication Data

US 2008/0280464 A1 Nov. 13, 2008

(30) Foreign Application Priority Data

May 7, 2007 (TW) ..... 96207251 U

(51) Int. Cl.
*H01R 12/00* (2006.01)

(52) U.S. Cl. ..... 439/71; 439/73

(58) Field of Classification Search ..... 439/717, 439/66, 70–73, 540.1, 330
See application file for complete search history.

(56) References Cited

U.S. PATENT DOCUMENTS 4,341,429 A * 7/1982 Bright et al. ..... 439/268
5,788,347 A * 8/1998 Rabinovitz ..... 312/111
6,679,707 B1 * 1/2004 Brodsky et al. ..... 439/71
6,881,073 B2 4/2005 Bali et al.
7,037,116 B1 * 5/2006 Liao et al. ..... 439/71
7,322,844 B1 * 1/2008 Hougham et al. ..... 439/342
7,473,106 B2 * 1/2009 Liao et al. ..... 439/71

* cited by examiner

*Primary Examiner*—Xuong M Chung-Trans
(74) *Attorney, Agent, or Firm*—Andrew C. Cheng; Wei Te Chung; Ming Chieh Chang

(57) ABSTRACT

An electrical connector (1) includes four pieces of insulative housing segments (21) having a number of electrical contacts (3) received therein. Each insulative housing segment includes two engaging edges (213) for attaching with another adjacent two insulative housing segments, the at least one engaging edge having at least one connect portion (215) formed thereon. At least one joining member (4) connects the connect portions of the at least two insulative housing segments.

7 Claims, 3 Drawing Sheets

ELECTRICAL CONNECTOR

BACKGROUND OF THE INVENTION

1. Field of the Invention

The present invention relates to the art of an electrical connector, and particularly to an electrical connector for electrically connecting an electrical package, such as electrical package, with a circuit substrate, such as a printed circuit board (PCB).

2. Description of Prior Arts

An electrical connector for electrically connecting an electrical package to a PCB is disclosed in U.S. Pat. No. 6,881,073 issued on Apr. 19, 2005. The electrical connector includes a frame defining a window, a plurality of housing segments received in the window and combined together as an unitary one via the frame. Each housing segment includes a frame edge for engaging with the frame. The housing segment defines a plurality of passageways for accommodating the electrical contacts.

As is described above, the housing segments are combined as an unitary structure via the frame, that would complicate the assembly of the electrical connector and waste a lot of material.

Hence, it is desirable to provide an improved electrical connector to overcome the aforementioned disadvantages.

SUMMARY OF THE INVENTION

An object of the present invention is to provide an electrical connector having a plurality of housing segments combined together without a frame.

To achieve the above object, an electrical connector includes at least two insulative housing segments having a plurality of electrical contacts received therein. Each insulative housing segment comprises at least one engaging edge for attaching with another insulative housing segment, the at least one engaging edge having at least one connect portion formed thereon. At least one joining member connects the connect portions of the at least two adjacent insulative housing segments.

Advantages of the present invention are to provide an electrical connector includes a number of joining members connecting the housing segments. It is easy to assemble of the electrical connector and a lot of material could be saved.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
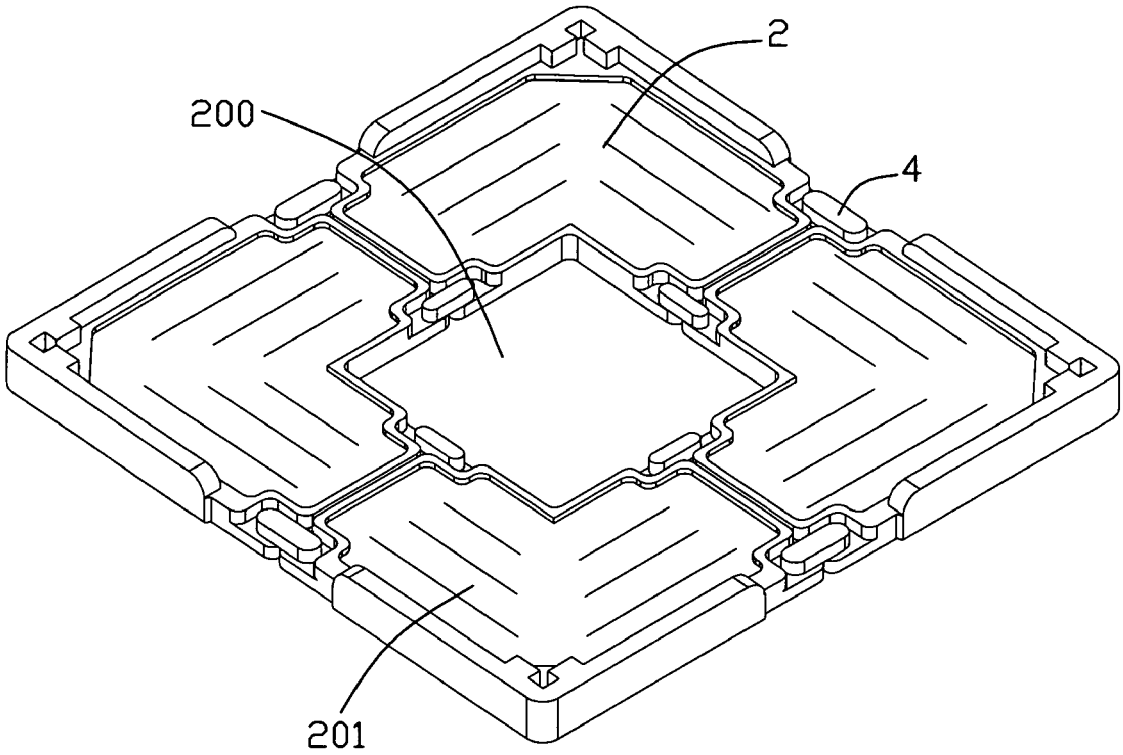
FIG. 1 is an assembled perspective view of an electrical connector according to the present invention.
Figure 2:
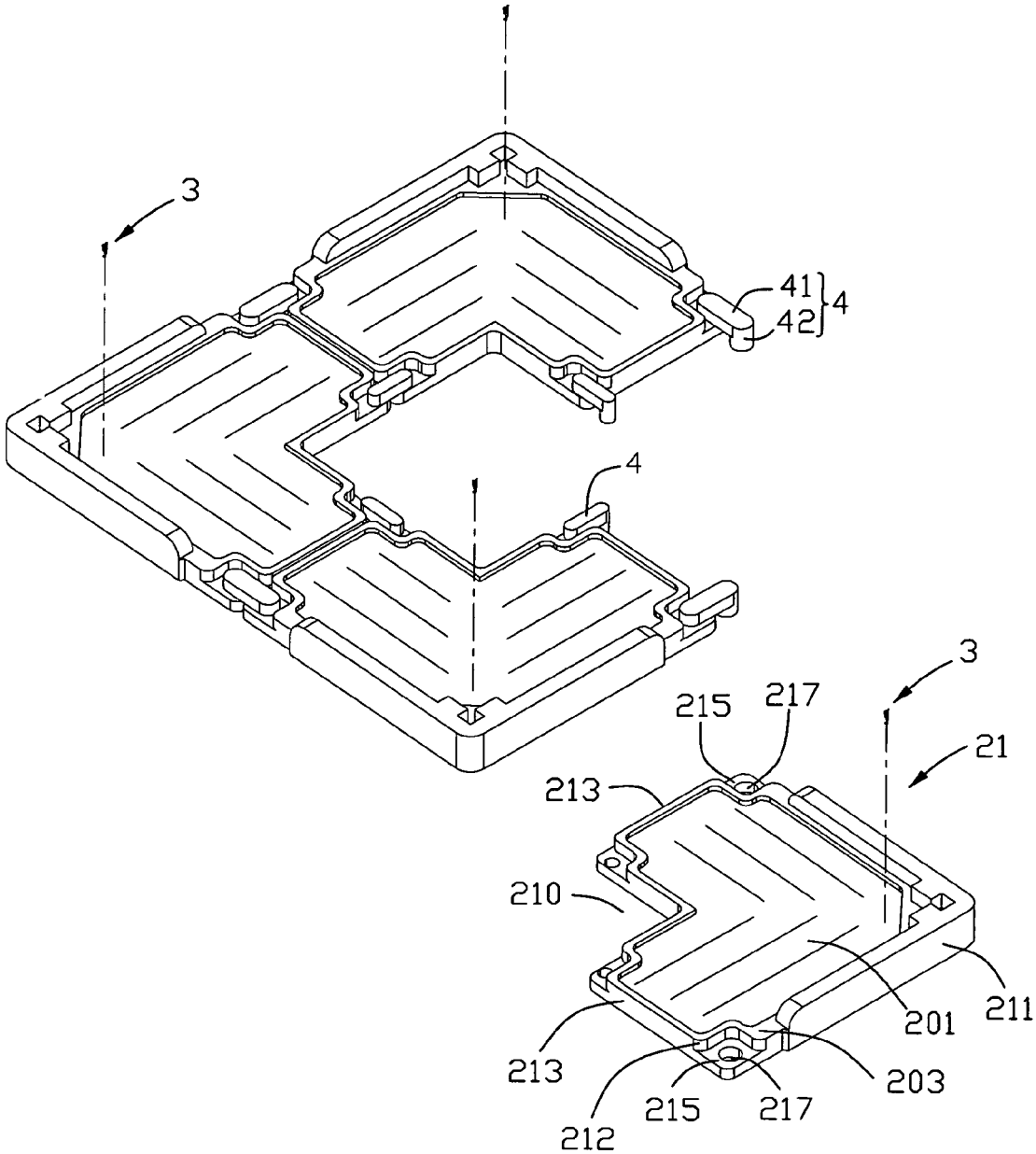
FIG. 2 is a perspective view of the electrical connector as shown in FIG 1, showing one insulative housing segment separated from the others.
Figure 3:
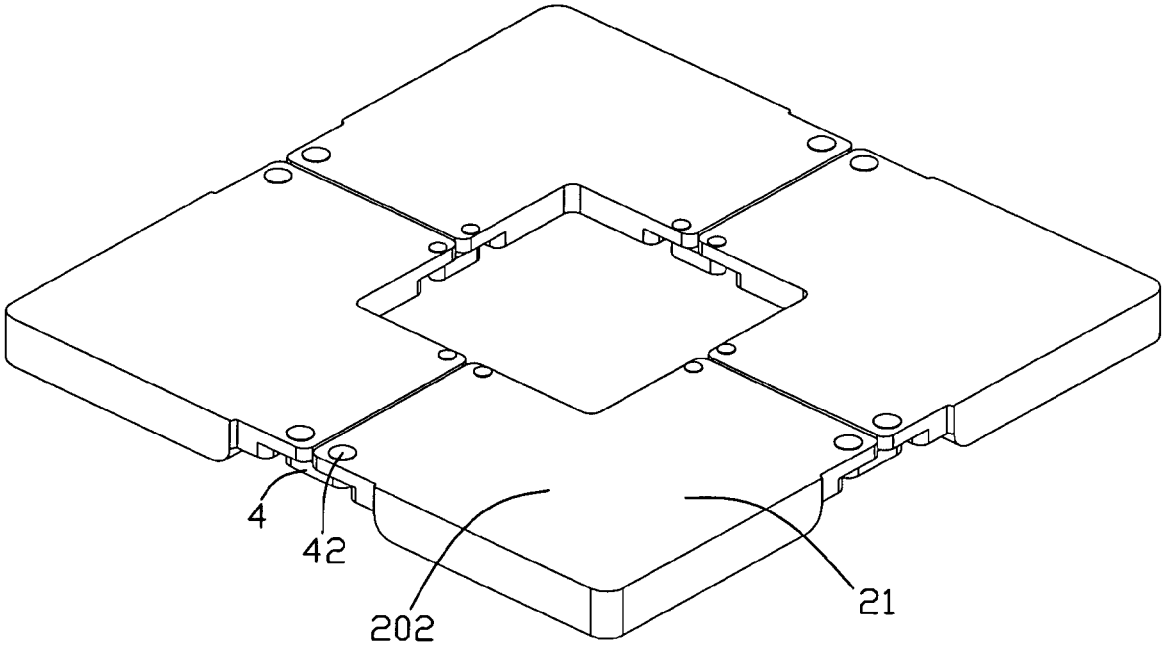
FIG. 3 is a perspective view similar to FIG. 1, taken from another aspect.

Reference will now be made to the drawing figures to describe the present invention in detail. FIGS. 1-3 show an electrical connector 1 electrically connecting an electrical package (not shown) with a PCB (not shown). The electrical connector 1 includes an insulative housing 2, a plurality of contacts 3 received in the insulative housing 2, and a number of joining members 4.

Referring to FIGS. 1 and 3, the insulative housing 2 of a substantially rectangular shape has a square-shaped opening 200 defined in a central region. The insulative housing 2 includes four pieces of insulative housing segments 21 having a mating surface 201 for connecting with the electrical package, and an opposed mounting surface 202 for mounting on the PCB.

Referring to FIG. 2, the insulative housing segment 21 has a plurality of passageways (not labeled) extending through the mating surface 201 and the mounting surface 202 for receiving the contacts 3. The insulative housing segment 21 is a substantially rectangular section having an indentation 210 defined on a corner region thereof, and a bent wall 211 formed on another two sides (not labeled). The insulative housing segment 21 further has a plurality of supporting edges 212 formed on the mating surface 201 and along outer edges thereof for supporting the electrical package. Each supporting edge 212 has an upper surface 203 lower than a top surface of the electrical contacts 3 and higher than the mating surface 201 of the insulative housing segments 21. When the four pieces of insulative housing segments 21 are combined together as an unitary structure, the indentations 210 are combined to form the square-shaped opening 200, and the bent walls 211 are combined to form four walls surrounding the insulative housing 2. The insulative housing segment 21 has two engaging edges 213 for attaching two adjacent insulative housing segments 21. Each engaging edge 213 has two connect portions 215 respectively formed on two ends thereof. Each connect portion 215 has an aperture 217 for receiving a post 42 formed on the joining member 4.

The contacts 3 are received in the passageways and extending outwardly from the mating surfaces 201 of the insulative housing segments 21. The contact 3 has the top surface higher than the upper surface 203 of the supporting edges 212 for electrically connecting with the electrical package.

Each two adjacent insulative housing segments 21 have two joining members 4 provided therebetween. Each joining member 4 is made of metal or plastic material, having a middle portion 41 and two posts 42 formed thereon for respectively engaging with the apertures 217 of the two adjacent connect portions 215 (see FIG. 3). Understandably, in other embodiment, the posts can be provided on the connect portions 215 and the apertures can be defined in the joining members 4 for receiving the posts. As known to the persons having ordinary skill in the art, any types of the engagements between the joining member 4 and the connect portions 215 are in the scope of the present invention. The joining member 4 has an upper surface (not labeled) lower than the upper surface 203 of the supporting edges 212. Obviously, in other words, the connect portion 215, which receives the joining member 4, has a top face lower than the upper surface 203 of the support edges 212. That is, the connect portion 215 is downwardly recessed from other regions of the housing segment 21. The four pieces of insulative housing segments 21 are combined together as an unitary structure via the joining members 4.

In other embodiment, the joining members 4 has one post (not shown) formed thereon. The connect portion 215 has a bottom surface (not shown) upper than an upper surface (not shown) of another adjacent connect portion 215. The two adjacent connect portions 215 are overlapped and the corresponding apertures 217 are aligned with each other for insertion of the post of the joining member 4. Therefore, the two adjacent connect portions 215 could be joined together via one post formed on the joining member 4.

Other objects, advantages and novel features of the invention will become more apparent from the following detailed description of a preferred embodiment when taken in conjunction with the accompanying drawings.

What is claimed is:

1. An electrical connector for connecting an electrical package with a printed circuit board, comprising:

at least two insulative housing segments having a plurality of electrical contacts received therein and positioned side-by-side, each insulative segment comprising at least one engaging edge for attaching with another insulative housing segment, the at least one engaging edge having at least one connect portion formed thereon; and at least one joining member removably secured to said at least two insulative housing segments by connecting the connect portions of the at least two insulative housing segments;

wherein said connect portion has at least one aperture defined thereon, and the joining member comprises a middle portion and two posts respectively engaging with the apertures of the two adjacent connect portions; wherein each insulative housing segment is a substantially rectangular section having an indentation defined on a corner region thereof; wherein each insulative housing segment has a mating surface for connecting with the electrical package; wherein each insulative housing segment further has a plurality of supporting edges formed on the mating surface and along outer edges thereof for supporting the IC package, each supporting edge having an upper surface higher than the mating surface and lower than a top surface of the electrical contacts; wherein said joining member has an upper surface lower than the upper surface of the supporting edges; wherein the connect portion is downwardly recessed from other portions of the corresponding insulative housing segment so as to receive the joining member therein for maintaining an even surface on an upper face of the assembled insulative housing segments.

2. The electrical connector as claimed in claim 1, wherein said insulative housing segment comprises two engaging edges respectively disposed on two sides thereof.

3. The electrical connector as claimed in claim 2, wherein said insulative housing segment further comprises a wall formed on another two sides thereof.

4. The electrical connector as claimed in claim 1, wherein there are four insulative housing segments combined together as an unitary structure via plural joining members.

5. An electrical connector assembly comprising:

a plurality of housing units compactly joined with one another and commonly defining a center cavity;

a plurality of connect portion formed on each of said housing units adjacent to corresponding side edges, and each of said connect portions defining an aperture therein, said connect portions being downwardly recessed from other regions of the corresponding housing units and each of said connect portions confronting a corresponding connect portion of a neighboring housing unit; and a plurality of joining members each having a pair of posts respectively inserted into the apertures of the corresponding two neighboring connect portions;

wherein each of said joining members defines a U-shaped configuration with a bar linking said pair of posts under a condition that the bar is compliantly received in the corresponding two neighboring recessed connect portions of the corresponding two neighboring housing units; wherein each housing unit has a mating surface for connecting with an IC package; wherein each housing unit further has a plurality of supporting edges formed on the mating surface and along outer edges thereof for supporting the IC package, each supporting edge having an upper surface higher than the mating surface and lower than a top surface of the electrical contacts; wherein said joining member has an upper surface lower than the upper surface of the supporting edges.

6. An electrical connector assembly for interconnecting a chip to a printed circuit board, comprising:

a first housing unit and a second housing unit arranged in side-by-side relationship, each receiving a plurality of contacts therein;

at least one connect portion formed by a first connect portion defined in a corner of the first housing unit and a second connect portion defined in a corner of the second housing unit, said at least one connect portion defining a face parallel to a mating face confronting the chip; and a joint member attached to the at least one connect portion and connecting the two housing units together;

wherein the joint member defines a U-shaped con figuration with a bar linking a pair of posts under a condition that the bar is compliantly received in the connect portion, and wherein the first and the second connect portion each define a hole for insertion of the posts of the joint member; wherein each housing unit has a mating surface for connecting with the chip; wherein each housing unit further has a plurality of supporting edges formed on the mating surface and along outer edges thereof for supporting the chip, each supporting edge having an upper surface higher than the mating surface and lower than a top surface of the electrical contacts; wherein said joining member has an upper surface lower than the upper surface of the supporting edges; wherein the connect portion is downwardly recessed from other portions of the corresponding housing unit so as to receive the joining member therein for maintaining an even surface on an upper face of the assembled housing units.

7. The electrical connector assembly as claimed in claim 6, wherein the joint member defines a pair of holes thereon and wherein the first and the second connect portion each defines a post for inserting into corresponding holes of the at least one joint member.

* * * * *